US010532449B2

(12) United States Patent
Hieronymus

(10) Patent No.: US 10,532,449 B2
(45) Date of Patent: Jan. 14, 2020

(54) ORTHOTIC REMOVAL TOOL

(71) Applicant: Carolyn Hieronymus, McKee, KY (US)

(72) Inventor: Carolyn Hieronymus, McKee, KY (US)

( * ) Notice: Subject to any disclaimer, the term of this patent is extended or adjusted under 35 U.S.C. 154(b) by 0 days.

(21) Appl. No.: 16/437,079

(22) Filed: Jun. 11, 2019

(65) Prior Publication Data

US 2019/0291249 A1 Sep. 26, 2019

Related U.S. Application Data

(63) Continuation-in-part of application No. 15/659,752, filed on Jul. 26, 2017, now abandoned.

(51) Int. Cl.

| | |
|---|---|
| ***B25B 27/00*** | (2006.01) |
| ***A43B 17/00*** | (2006.01) |
| ***A43B 7/14*** | (2006.01) |
| ***A47G 25/90*** | (2006.01) |
| ***A47G 25/82*** | (2006.01) |

(52) U.S. Cl.

CPC ..... *B25B 27/00* (2013.01); *A43B 7/1405* (2013.01); *A43B 17/00* (2013.01); *A47G 25/90* (2013.01); *A47G 25/82* (2013.01)

(58) Field of Classification Search

CPC ..... A43B 17/00; A43B 7/1405; A43D 5/04; A43D 5/00; A43D 5/005; A47G 25/82; A47G 25/908; B25B 27/00; B25B 23/18; F21V 32/008; F21V 33/0084

USPC ..... 30/336, 164.9, 317, 329, 340, 123; 362/109, 118–120; 12/103; 223/118

See application file for complete search history.

(56) References Cited

U.S. PATENT DOCUMENTS 128,756 A * 7/1872 Sanford ..... A43D 5/005 7/102
1,206,585 A * 11/1916 Parrahm ..... A43D 5/00 12/103
1,616,040 A * 2/1927 Gulliver ..... A43D 5/04 30/287
1,692,481 A * 11/1928 Wilkins ..... A43D 3/08 12/115.2
1,825,111 A * 9/1931 De Witt ..... A43D 3/1441 12/103
1,913,709 A * 6/1933 Gutmann ..... A47G 25/82 223/118
2,242,536 A * 5/1941 Montgomery ..... B25B 23/18 362/578
2,449,535 A * 9/1948 Scholl ..... A43B 7/22 294/61
2,484,692 A * 10/1949 De Luce ..... A47G 19/28 30/342
2,661,487 A * 12/1953 Hicks ..... A43D 5/00 12/103

(Continued)

*Primary Examiner* — Ghassem Alie
*Assistant Examiner* — Bharat C Patel
(74) *Attorney, Agent, or Firm* — Michael Coblenz

(57) ABSTRACT

A tool for removing orthotic inserts from inside of a shoe. The tool consists of a blade with a narrow tip for inserting between the edge of the orthotic and the inside of the shoe, a housing attached to the blade, the housing internally containing an LED light, a battery, a controller, and an on/off switch to active the light, and a handle use for leverage to remove the orthotic. The handle is covered by a soft pliable rubberized grip made of a silica gel material.

4 Claims, 3 Drawing Sheets

(56) References Cited

U.S. PATENT DOCUMENTS 3,292,478 A * 12/1966 Falk ..... B26F 1/44 83/679
3,603,782 A * 9/1971 Wortmann ..... B25B 15/00 362/120
3,818,592 A * 6/1974 Himeno ..... B26B 3/00 30/151
4,107,765 A * 8/1978 Singleton ..... B25B 23/18 362/120
4,215,601 A * 8/1980 Mann ..... B25B 27/00 81/57.13
4,248,660 A * 2/1981 Johnson ..... A47L 13/08 15/236.01
4,283,757 A * 8/1981 Nalbandian ..... B25B 23/18 362/119
4,768,137 A * 8/1988 Hwaw ..... B25B 23/18 362/120
4,936,171 A * 6/1990 Berg ..... B25B 23/18 362/120
5,051,876 A * 9/1991 Norman ..... B25B 15/00 324/506
5,211,468 A * 5/1993 Jeng ..... B25B 23/18 362/109
5,369,555 A * 11/1994 McKain ..... B25B 23/18 362/120
5,474,565 A * 12/1995 Trott ..... A61B 17/0469 128/898
5,826,969 A * 10/1998 Nevin ..... G02B 6/0006 362/120
5,964,517 A * 10/1999 Adams ..... A47J 37/0786 362/109
5,980,077 A * 11/1999 Shiao ..... B25B 23/0035 362/120
6,158,493 A * 12/2000 Hildebrand ..... B44D 3/162 15/236.01
6,213,621 B1 * 4/2001 Chien ..... B25B 23/18 362/109
6,223,633 B1 * 5/2001 Chien-Chich ..... B25B 15/02 279/79
6,259,438 B1 * 7/2001 Fleck ..... G06F 3/03545 178/19.01
6,419,371 B1 * 7/2002 McCalla ..... B25B 23/18 362/109
6,464,370 B1 * 10/2002 Ulicny ..... B26B 11/008 362/109
6,474,518 B1 * 11/2002 Diaz-Acosta ..... A47G 25/82 223/118
6,574,886 B1 * 6/2003 Issler ..... A43B 3/108 12/142 C
6,675,483 B2 * 1/2004 Bond ..... A47G 21/02 30/142
6,749,318 B1 * 6/2004 Palacios ..... B25F 1/003 30/169
6,954,961 B2 * 10/2005 Ferber ..... A61C 17/22 15/105
7,400,228 B2 * 7/2008 Abeyta ..... G08B 7/068 116/63 P
7,792,424 B2 * 9/2010 Chen ..... G03B 17/563 396/535
8,764,213 B2 * 7/2014 Cammenga ..... B26B 11/008 362/119
9,061,427 B2 * 6/2015 Rubin ..... B26B 11/00
9,085,073 B2 * 7/2015 Hossack ..... B25C 3/008
9,851,060 B2 * 12/2017 Pathy ..... F21L 4/02
2003/0112622 A1 * 6/2003 Chu ..... A01K 97/18 362/109
2008/0172800 A1 * 7/2008 Levy ..... B25B 27/00 7/107
2009/0019709 A1 * 1/2009 Fisher ..... A47G 21/02 30/344
2010/0011593 A1 * 1/2010 Trbovich, Jr. ..... B26B 11/008 30/340
2010/0106015 A1 * 4/2010 Norris ..... A61B 10/0275 600/437
2011/0063820 A1 * 3/2011 Wang ..... B25B 23/18 362/120
2011/0090673 A1 * 4/2011 Shih ..... B25B 23/18 362/119
2011/0289780 A1 * 12/2011 Tiegs ..... B26B 11/008 30/123
2012/0059226 A1 * 3/2012 Funt ..... A61B 17/02 600/213
2016/0220013 A1 * 8/2016 Barnes ..... A46B 9/04
2017/0106510 A1 * 4/2017 Galtieri ..... B25B 27/00

* cited by examiner

ORTHOTIC REMOVAL TOOL

CROSS REFERENCE TO RELATED APPLICATIONS

This application is a continuation in part of, and claims priority to, U.S. patent application Ser. No. 15/659,752 filed on Jul. 26, 2017, and fully incorporated herein by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The present invention relates to a small hand-held tool use to remove orthotic inserts from shoes.

Description of the Related Art

Orthotic inserts, commonly referred to as simply "orthotics", are pad like inserts that are placed on the footbed inside of shoes. Orthotics are used to aid an individual with balance and walking, and a variety of foot related health issues. U.S. Pat. No. 4,597,196, to Brown, describes the orthopedic uses of the orthotic, and the human physiology associated with the use of orthotics, and its teachings are incorporated herein. The orthotic is specifically designed for each individual user. In many cases the orthotic is specially molded to the shape of the bottom of the user's foot. Most people own many pairs of shoes but will typically only have one or two sets of specially designed orthotics. This is due, in part, to the fact that orthotics can be expensive. As a result the individual will have to remove the set of orthotics from one pair of shoes and insert them into a new pair of shoes, every time the individual wishes to change shoes. This is often quite difficult because the orthotics are designed to fit securely within the shoe.

It is important that the orthotic be securely held within the shoe. If the orthotic slips within the shoe it could lead to an imbalance for the wearer and potentially lead to a stumble or fall. As a result, orthotics are typically snuggly and securely held within the shoe. Unfortunately, because the orthotic is snuggly inserted into the shoe it can be very difficult to remove the orthotic from the shoe. Orthotics are often commonly worn by the elderly, who frequently have limited dexterity and hand strength. Both make it difficult to remove orthotics from shoes. There is a need, therefore, for a device that will aid in the removal of orthotics from shoes.

SUMMARY OF THE INVENTION

The present invention is a small hand-held tool with a narrow tip that is sized to slide into the shoe and between the edge of the inserted orthotic and the inside edge of the shoe to allow the user to lift up an edge of the orthotic to allow its removal. The tool includes a grip end with soft material to aid in holding the tool. There is an LED light incorporated into the tool so that the removal tool can be used in low light or in a dark room.

DETAILED DESCRIPTION OF THE INVENTION

Detailed embodiments of the present invention are disclosed herein. It is to be understood that the disclosed embodiments are merely exemplary of the invention, and that there may be a variety of other alternate embodiments. The figures are not necessarily to scale, and some features may be exaggerated or minimized to show details of particular components. Therefore, specified structural and functional details disclosed herein are not to be interpreted as limiting, but merely as a basis for teaching one skilled in the art to employ the varying embodiments of the present invention.

Figure 1:
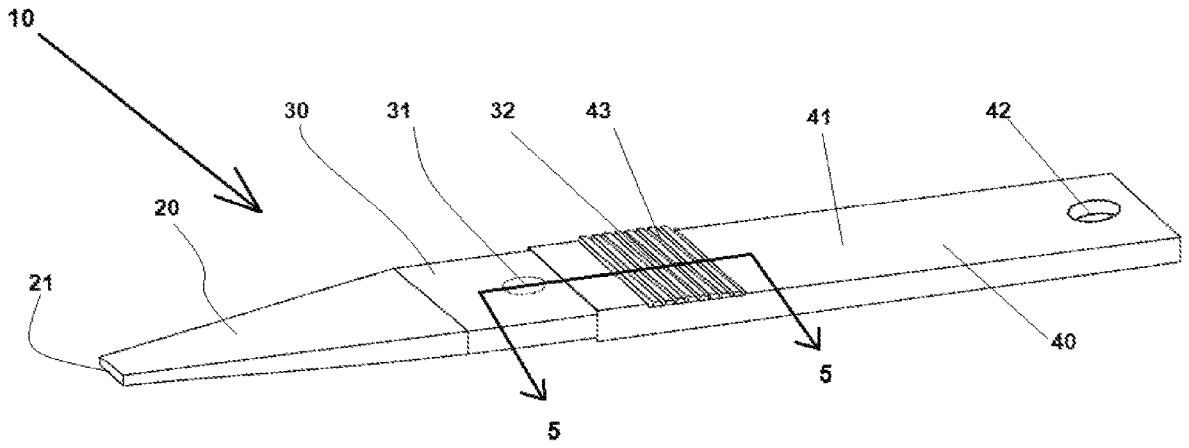
FIG. 1 is a perspective view of one embodiment of the orthotic removal tool.

FIG. 1 is a perspective view of the orthotic removal tool 10 showing most of the components. The orthotic removal tool 10 consists of blade 20 attached to a housing 30 which is attached to a handle 40. In one embodiment the blade 20, housing 30 and handle 40 are made from a single piece of material. In this embodiment the outside surface of the housing 30 and the handle 40 are contiguous and co-equal, without breaks or changes in sizes in any aspect, and the front end of the housing 30 then tapers to form the blade 20. In one embodiment the material is a light metal such as aluminum, but in most embodiments it is made of a rigid molded plastic. When molded in plastic the orthotic removal tool 10 is a single piece with the handle 40 connected to the housing 30 which is then connected to the blade 20, and wherein the housing 30 is molded to include the opening 33 therein. The blade 20 has a tip 21 that is narrow enough to fit under an orthotic O that is securely fitted into the inside of a shoe S.

Figure 5:
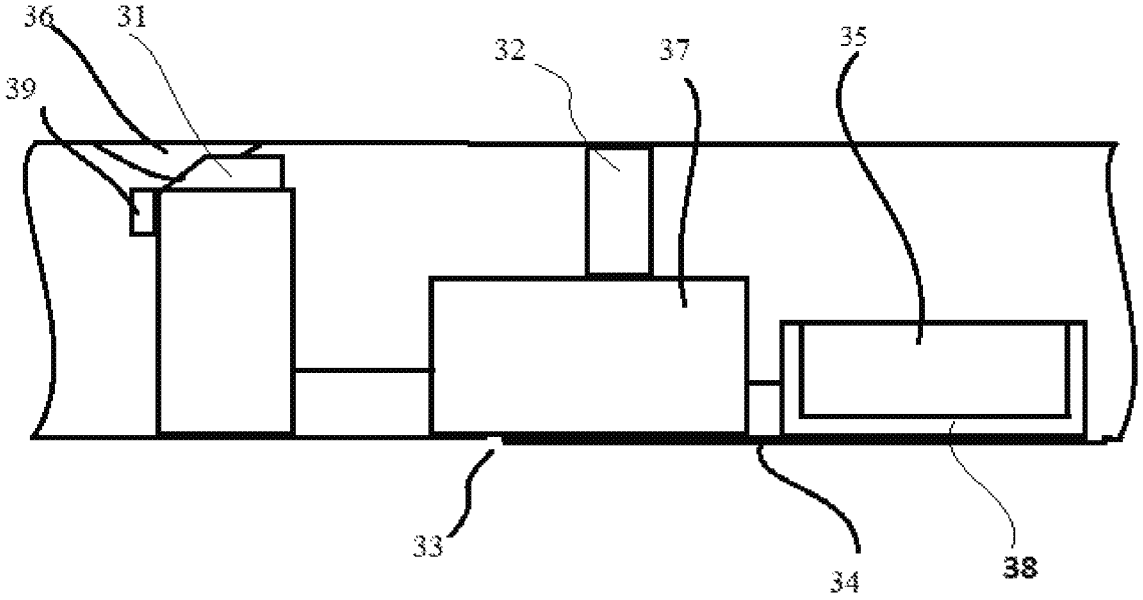
FIG. 5 is a detailed cut away schematic drawing showing the internal electronic components of the invention.

The housing 30 has a housing opening 33 on the back side of the tool 10, with a housing cover 34 to securely close the opening 33. As seen in the schematic cut-away of FIG. 5, the opening 33 is a small cavity within the housing 30 and which provides access to insert the LED 31, the battery 35 that provides electrical power to operate the LED 31, and the button 32 or on/off switch that turns on and off the LED 31. There is an opening cover 34 that closes the opening. The cover 34 is attached in any number of convention ways, typical of small battery access covers for small electronic devices. This can be a slip in and snap into place cover, or a hinged and snap closed cover. The manner of attachment of the cover is conventional. The battery 35 is replaceable, and sits in a standard battery holder 38. The LED 31, the battery holder 38 and the button 32 are electronically attached to a controller 37 so that the user can turn on and off the LED 31 by pressing the button 32. In the preferred embodiment the battery 35 is a standard flat watch battery, and the battery holder 38 is sized and configured to hold the watch battery 35. In the preferred embodiment the LED light 31, the button 32, and the battery holder 38 are all incorporated in a standard circuit board. Such integrated light, controller, and battery holder circuit boards are common and well known. The circuit board is inserted into the opening 33 such that the LED is disposed below the lens 36 and the batter holder 38 is accessible through the opening 33 for ease of replacement of the battery 35.

The handle 40 is attached to and extends from the housing 30. In one embodiment there is a hole 42 located at the end of the handle 40 to allow the orthotic removal tool 10 to be hung up on a hook or peg, or to attach a string or lanyard. There is a handle cover 41 that is sized to fit and is disposed over the handle 40 and the end portion of the housing 30 that covers the on/off switch button 32. The handle cover 41 is made from a soft rubberized material that makes it easier to hold the handle 40 and to manipulate the orthotic removal tool 10. In one embodiment there are a series of ridges 43 that provide additional gripping at the housing end of the handle cover 41. The ridges 43 are located where the user's thumb will typically be placed on the handle 40 or the housing 30, placing the thumb directly over the button 32, so that the user can activate the LED 31.

In the preferred embodiment the handle cover 41 is made of soft and pliable, yet durable, silica gel, which is known and commonly used for similar purposes. It is sized to fit snugly over the handle 40 and part of the housing 30. With modern production techniques the gel handle cover 41 can be precisely sized to fit snugly and securely over the handle 40. The handle 40 is attached to the blade 20, either directly or in combination with the housing 30, so that the handle 40 provides leverage when the tip 21 is inserted under the orthotic and the orthotic removal tool 10 is used as a lever to dislodge the orthotic O from the inside of the shoe S.

The orthotic removal tool 10 includes a LED 31 and an on-off button 32 to turn the LED 31 on and off. The integrated LED 31 serves two separate purposes. First it allows the use of the orthotic removal tool 10 in rooms with low or no light, such as a darkened bedroom where one occupant is sleeping. The user can use the LED 31 as a flashlight to find shoes and orthotics. The LED 31 also allows the user to illuminate the inside of the shoe, which aids in locating a convenient spot to insert the tip 21 between the side of the shoe and the orthotic.

The LED 31 is a standard small LED light. In one embodiment there is a small beveled lens 36 placed over the LED 31 such that the light from the LED 31 is directed toward the tip 31 end of the blade 30. The button 32 can turn on and off the LED 31 in at least two iterations. In one version the button 32 is a pressure sensitive button that only turns on the LED 31 when the button 32 is pressed. In a second embodiment the button 32 is an on-off switch button that turns on with the first push, then turns off with the second push. In a third embodiment the LED 31 includes a light sensitive electric eye diode 39 that will only allow the LED 31 to be illuminated when the area is dark. In a fourth embodiment there is a pressure sensitive switch attached between the blade 20 and the housing 30 that turns on and off the LED when the tip 21 of the blade 20 is twisted when the tip 21 is inserted under the orthotic.

In one embodiment, shown in FIG. 1, the blade 20 is a beveled tetrahedron that narrows from where it attaches to the housing 30 down to the tip 21, and also becomes thinner from the housing 30 to the tip 21. In an alternate embodiment, shown in FIG. 4, the blade 20*s* is a curved, concave, and somewhat spoon shape, which narrows to a curved tip 21*a*. Either can easily be molded from plastic or soft metals. In either embodiment the tip 21 or the curved tip 21*a* are sized to fit between the inside surface of the shoe S and the outside edge of the orthotic O, so that the user can slide the orthotic removal tool 10 under the orthotic O to remove it from the inside of the shoe S.

In the preferred embodiment the orthotic removal tool 10 is 9 inches long from the tip 21 to the hole 42 end, it is 1½ inches wide and one eighth inch thick. It is understood that the size can vary, but since it is a small hand tool it won't be longer than 12 inches or shorter than 6 inches, nor wider than 2 inches or narrower than one half inch.

Figure 2:
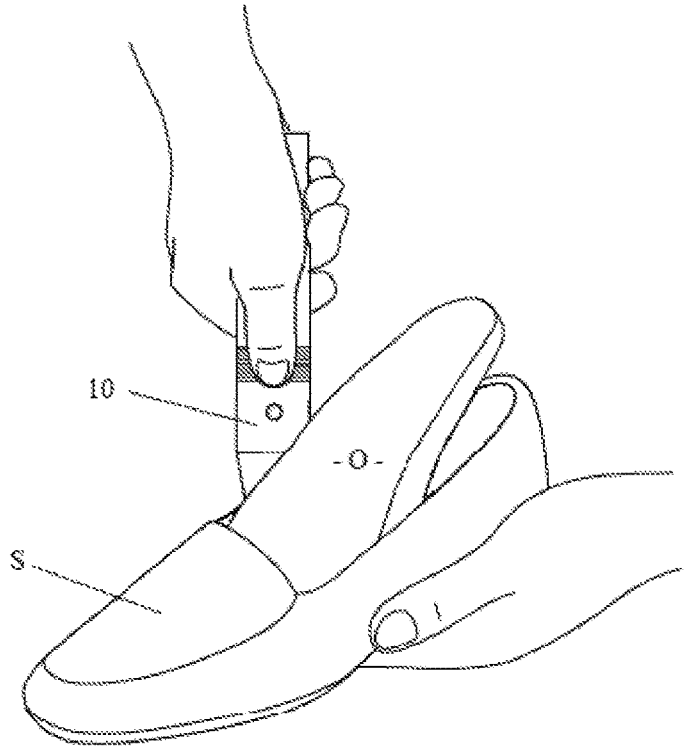
FIG. 2 is a perspective view of the orthotic removal tool in use.
Figure 3:
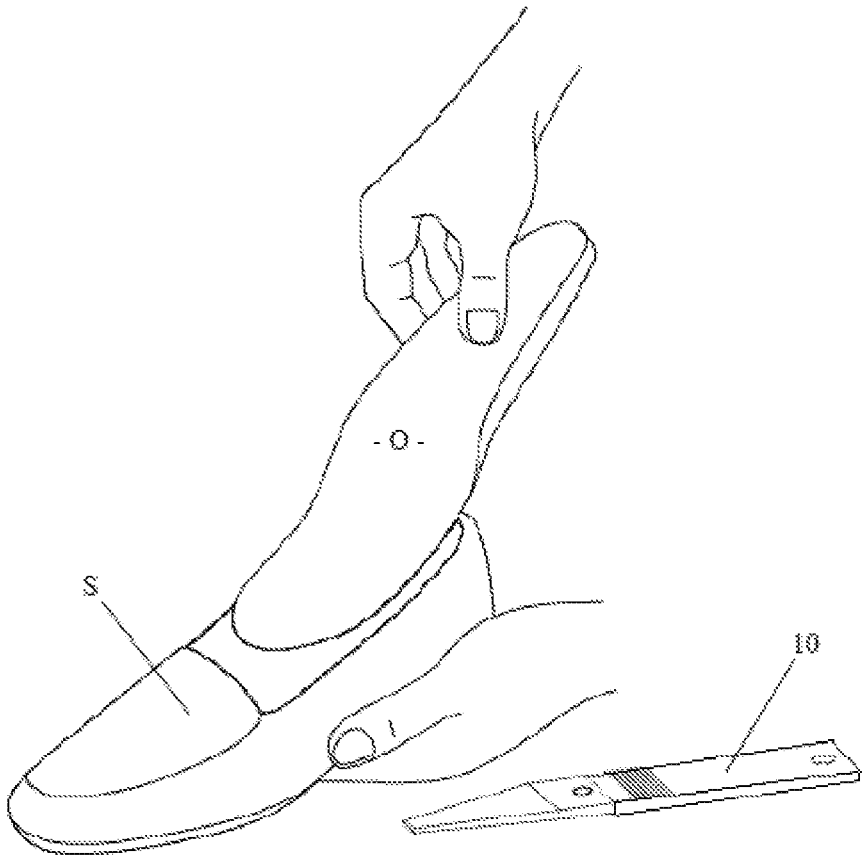
FIG. 3 is a perspective view of the orthotic being removed from the shoe.
Figure 4:
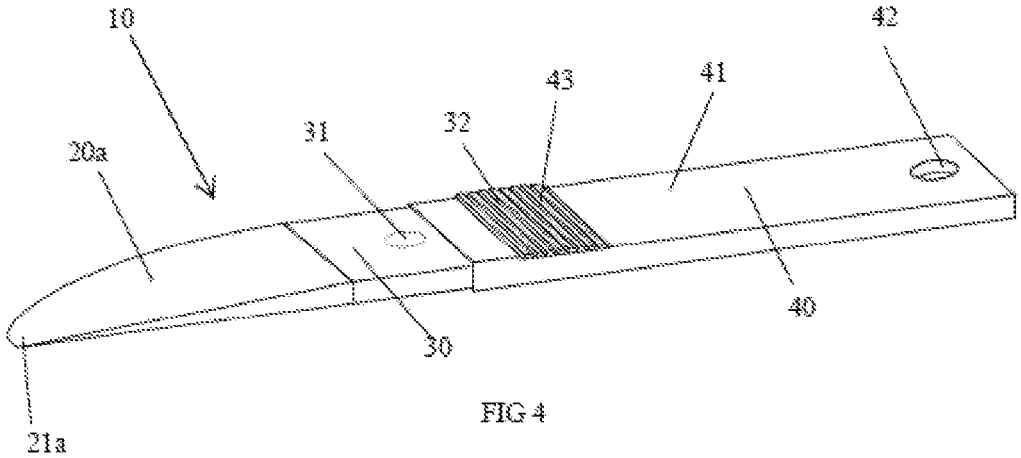
FIG. 4 is a perspective view of a second embodiment of the invention.

The orthotic removal tool 10 is shown in use in FIG. 2 and FIG. 3. In use the tool 10 is held by the handle 40, and the tip 21 is inserted into the shoe S and between the inside edge of the shoe S and the orthotic O securely inserted therein. The tip 21 is narrow enough to slide between the inside of the shoe S and the orthotic O, but if it is not the shoe S is generally made of a somewhat pliable material such as leather that has some give so that the edge of the shoe S can be pushed away and the tip 21 slid under the orthotic O. The user can use the side of the shoe S as a fulcrum, and the handle 40 as a lever to pry the orthotic O upwards, as shown in FIG. 3. Once the orthotic O is up from the footbed of the shoe S the user can grab the orthotic O itself and remove it entirely from the shoe S as shown in FIG. 4. FIG. 3 shows the orthotic removal tool 10 being inserted under the arch near the middle of the orthotic O, but the tip 21 can be inserted anywhere to pry up the orthotic O.

The present invention is well adapted to carry out the objectives and attain both the ends and the advantages mentioned, as well as other benefits inherent therein. While the present invention has been depicted, described, and is defined by reference to particular embodiments of the invention, such reference does not imply a limitation to the invention, and no such limitation is to be inferred. The depicted and described embodiments of the invention are exemplary only, and are not exhaustive of the scope of the invention. Consequently, the present invention is intended to be limited only by the spirit and scope of the claims, giving full cognizance to equivalents in all respects.

I claim:

1. An orthotic removal tool for removing an orthotic from the inside of a shoe, said orthotic removal tool comprising:

a handle to provide leverage;

a housing contiguous with and attached to said handle, said housing configured to internally hold a light, a battery to power said light, and a pressure sensitive on/off switch to active said light; wherein said on/off switch is located on the housing adjacent to the handle such that when a user holds said handle the on/off switch is below a thumb of the user holding said handle;

a blade attached to said housing, wherein said handle, said housing, and said blade create a planar elongated tool having a longitudinal axis;

a handle cover disposed over said handle and over the on/off switch in said housing, wherein said handle cover further includes a thumb grip area with a series of ridges perpendicular to said longitudinal axis and disposed over said on/off switch;

wherein said blade has a top with a top surface, a bottom, two sides, and a tip, wherein the top surface of said blade is tapered slightly downward, and at least one side of said blade is tapered inward toward said longitudinal axis to form a tip having a flat face perpendicular to said longitudinal axis, said tip configured for fitting between an edge of the orthotic and a wall of the inside of the shoe;

a beveled lens disposed over said light;

wherein when said light is illuminated the beveled lens directs said illumination at an acute angle to said longitudinal axis thereby illuminating the inside of the shoe to aid in locating an edge of said orthotic to aid in removal;

wherein said tip is inserted between the edge of the orthotic and the inside wall of the shoe and the handle is used to provide leverage to displace the orthotic to allow the removal of the orthotic from the shoe.

2. The orthotic removal tool of claim 1 wherein said light is an LED.

3. The orthotic removal tool of claim 1 wherein said handle cover is made of a silica gel material.

4. The orthotic removal tool of claim 1 wherein said handle further includes a hole disposed distally from said tip, said hole configured to allow the orthotic removal tool to be stored on a hook, or configured to allow the attachment of a string lanyard.

* * * * *